US007207551B2

(12) United States Patent
Fielden et al.

(10) Patent No.: US 7,207,551 B2
(45) Date of Patent: Apr. 24, 2007

(54) PRIVACY PANEL SYSTEM FOR ORNAMENTAL FENCE

(75) Inventors: Terry William Fielden, Newton, NJ (US); Michael Douglas Clayson, Puyallup, WA (US)

(73) Assignee: Filtrona Extrusion USA, Inc., Atlanta, GA (US)

( * ) Notice: Subject to any disclaimer, the term of this patent is extended or adjusted under 35 U.S.C. 154(b) by 0 days.

(21) Appl. No.: 10/853,712

(22) Filed: May 26, 2004

(65) Prior Publication Data

US 2005/0263750 A1 Dec. 1, 2005

(51) Int. Cl.
*E04H 17/16* (2006.01)

(52) U.S. Cl. ..... 256/24; 256/22

(58) Field of Classification Search ..... 256/19, 256/21, 22, 24, 73, 25, 27, 29; 405/247, 405/276, 277

See application file for complete search history.

(56) References Cited

U.S. PATENT DOCUMENTS

| | | | | |
|---|---|---|---|---|
| 3,648,981 | A * | 3/1972 | Allen | 256/24 |
| 4,188,019 | A * | 2/1980 | Meredith | 256/24 |
| 4,312,166 | A * | 1/1982 | Mock | 52/522 |
| 5,149,061 | A * | 9/1992 | Borgnini | 256/24 |
| 5,931,449 | A * | 8/1999 | Gwaltney | 256/24 |
| D455,219 | S * | 4/2002 | Ohanesian | D25/124 |
| 6,523,807 | B2 * | 2/2003 | Calverley | 256/25 |
| 2003/0030047 | A1 * | 2/2003 | Ohanesian | 256/24 |
| 2004/0012007 | A1 * | 1/2004 | Cummings | 256/65.1 |

* cited by examiner

*Primary Examiner*—Daniel P. Stodola
*Assistant Examiner*—Joshua T. Kennedy
(74) *Attorney, Agent, or Firm*—Jacobson Holman PLLC

(57) ABSTRACT

A privacy panel system for ornamental fences that include a plurality of panel members that are dimensioned to fit within adjacent pickets of the ornamental fence to close off and provide privacy between the pickets. Each panel member comprises a central section with offset attachment wings, the latter of which are affixed to the back planar face of the parallel fence pickets. The central section is offset to extend within and between adjacent pickets, but offset from the front face thereof. To provide privacy between a picket and a post, such as an end post, an elongated trim piece is provided having a first edge defining a slot with a slot gap substantially equal to the thickness of the privacy panel to enable a free edge of a central section of the privacy panel to be tightly retained within the slot. The free edge of the privacy panel is formed by cutting the central section vertically to provide a free end, which is rigidly and securely retained within the slot. Thus, the spacing between a picket and an end post, which is typically not of uniform spacing, can be closed off through the use of the end post trim piece in combination with the cut central section of the privacy panel.

12 Claims, 3 Drawing Sheets

PRIVACY PANEL SYSTEM FOR ORNAMENTAL FENCE

BACKGROUND OF THE INVENTION

1. Field of the Invention

The present invention relates to a privacy panel system for ornamental fences. Ornamental fences are formed from a plurality of vertically disposed parallel pickets and posts, including end posts, with horizontal intersecting rails. The privacy system includes a plurality of panel members that are dimensioned to fit within adjacent pickets to close off the opening defined by the pickets and rails, and further includes a specially cut panel fitted with a trim piece to fill the opening between a picket and a post.

2. Description of the Related Art

Ornamental fence systems are well known. Such fence systems are formed from a plurality of vertically disposed parallel pickets of aluminum, steel or plastic that are rectangular, preferably square, in cross-section. Horizontal rails or bars near the top and bottom are typically provided and ornamental designs in the areas of the topmost horizontal rails are sometimes utilized. Ornamental fences are often regulated for child safety and may be standardized to provide a maximum 4" spacing between adjacent pickets. The cross-section of the pickets are generally ⅝", ¾" or 1" square.

Ornamental fence products are relatively open and provide no privacy. A need has thus arisen for ornamental fence systems to include some means for ensuring privacy.

SUMMARY OF THE INVENTION

It is an object of the present invention to provide privacy for ornamental fence systems. It is an object of the present invention to provide privacy through the use of pre-cut opaque panels to fit within ornamental fence pickets having predetermined dimensions in a secure manner while maintaining the unique ornamental design and integrity of the fence.

Still further, it is an object of the present invention to provide an easily installed privacy system formed of standardized panels that are placed and secured within adjacent pickets. The panels may be pre-cut, or cut on the job for providing privacy in the space adjacent to an end post, where the spacing between the picket, or intermediate post, and end post might be less than the standard predetermined panel dimension.

It is still further an object of the present invention to quickly and easily provide a secure attachment of privacy panels to ornamental fence systems.

BRIEF DESCRIPTION OF THE DRAWINGS

These and other objects, features and many of the attendant advantages of this invention will be better understood by those with ordinary skill in the art in connection with the following detailed description of the preferred embodiments and the accompanying drawings wherein.

Like reference characters refer to like parts throughout the several views of the drawings.

DESCRIPTION OF THE PREFERRED EMBODIMENTS

Figure 1:
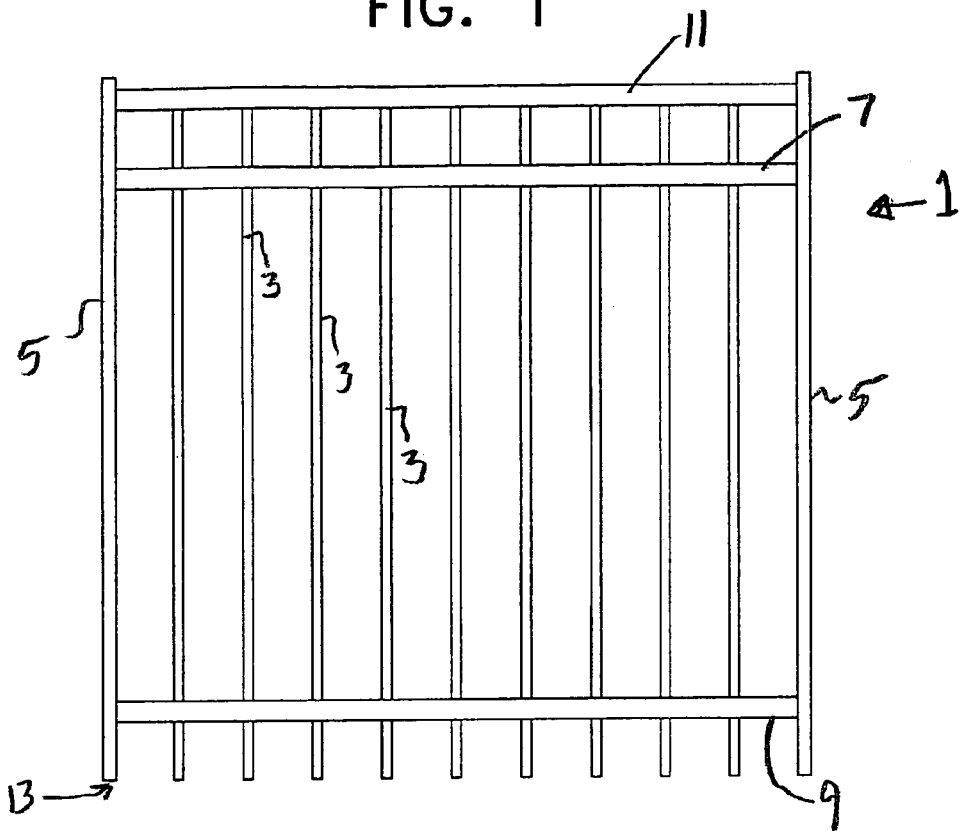
FIG. 1 is a front view of an ornamental fence section.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 6:
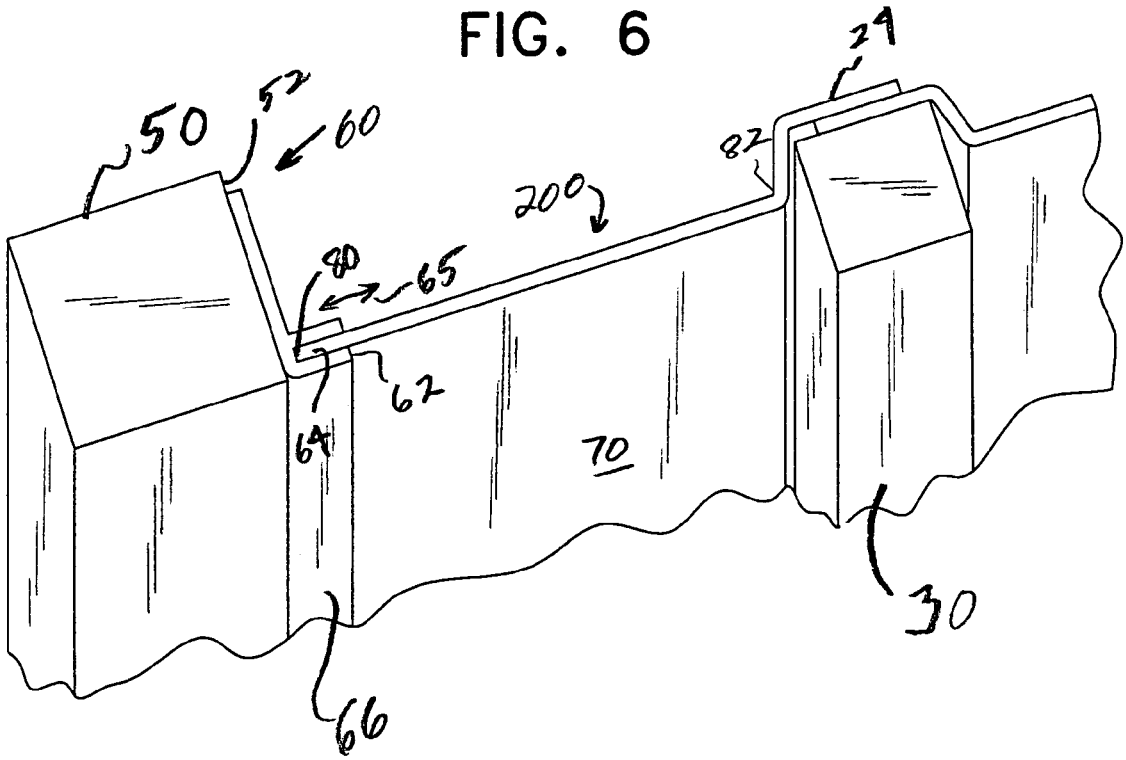
FIG. 6 is a perspective view of a cut privacy panel and trim piece attached to an ornamental fence.

Ornamental fences, a section 1 of which is shown in FIG. 1, include a plurality of pickets 3, typically ⅝", ¾" or 1" pickets, square in cross-section, of aluminum, steel or plastic, welded or attachable in components, wherein the pickets 3 are spaced no more than 4" apart or other dimensions as set by governmental safety standards. Posts 5 of greater size are located at the ends of the fence (end post 50; FIG. 6) or at predetermined locations along the overall fence length. Typically, end post 5, 50 is 2½" square. The parallel pickets 3 may be intersected by parallel, horizontally-oriented rails 7, 9, which have a cross-sectional size similar to the posts. These horizontal rails 7, 9 (may be positioned below a top rail) and above the bottom 13 of the fence 1, as determined by the fence style required. The standardization of the picket spacing in ornamental fencing assists in providing an economical, cost effective, privacy panel system of the present invention as will be described. The ornamental fence may be formed from a plurality of sections 1 and it is often the case that the distance between adjacent posts 5, or between an end post 50 and adjacent picket 30 may be less than the predetermined spacing.

Figure 4:
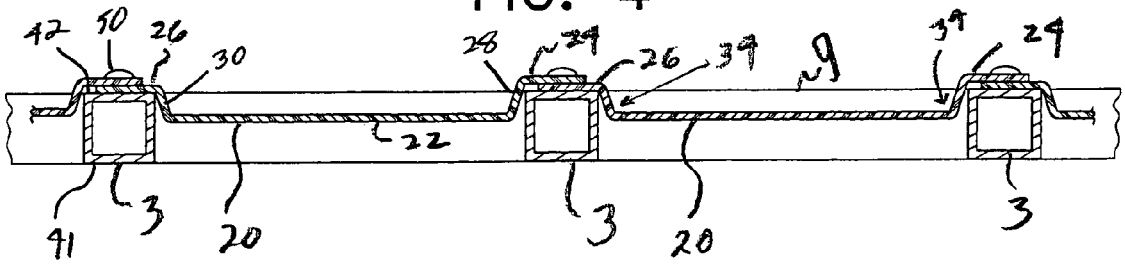
FIG. 4 is a cross-sectional view along line 4—4 of FIG. 3.
Figure 5:
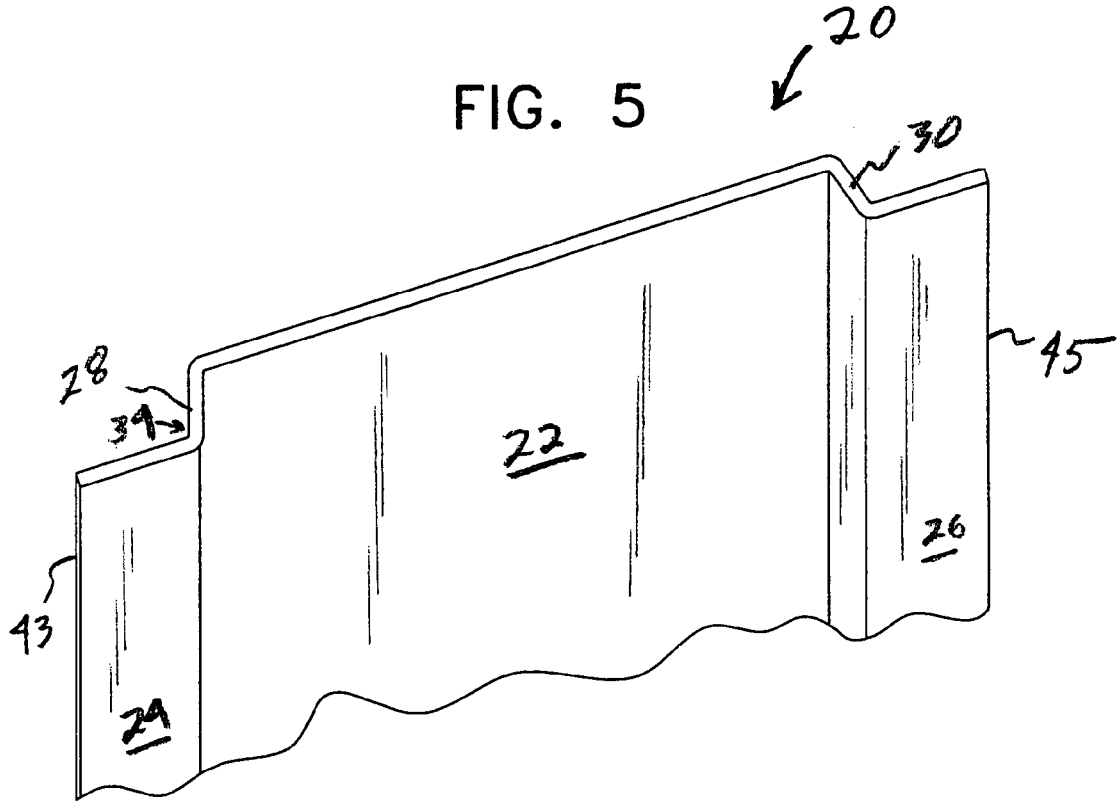
FIG. 5 is a perspective view of a privacy panel.

A privacy panel 20 is shown in perspective view in FIG. 5. Privacy panels 20 affixed to pickets 3 are also shown in top view in FIG. 4. The privacy panel 20 is opaque plastic and preferably of a color to match that of the ornamental fence pickets and posts. The privacy panel includes a central section 22 with attachment wings 24, 26 that are offset through transition sections 28, 30. Each of the central section 22 and attachment wings 24, 26 are, preferably, parallel to each other. For use with ornamental fences that are standardized as discussed above; the central section 22 is just under 4" or just under the width between adjacent pickets 3. The panel length is sized to extend between the top 7 and bottom 9 horizontal rails, which are also standardized. The transition sections 28, 30 are near perpendicular to the attachment wings, but preferably form slightly obtuse angles at 34. The central section 22 and integral transition sections 28, 30 completely close the opening between adjacent pickets 3.

The attachment wings 24, 26 are offset from the central section approximately ⅜" for pickets that are ⅝", ¾ inch or 1" square. That is, the offset dimension is less than the distance between front 41 and back 42 faces of the picket, so as to maintain the picket profile being visible and of different dimensions for aesthetic purposes. The overall width from wing tip 43 to wing tip 45 is just over 5" for 4" picket spacings to enable the privacy panel to fit within adjacent pickets and to enable the wings to be in facing relationship for attachment to the back face 42 of the picket.

Figure 2:
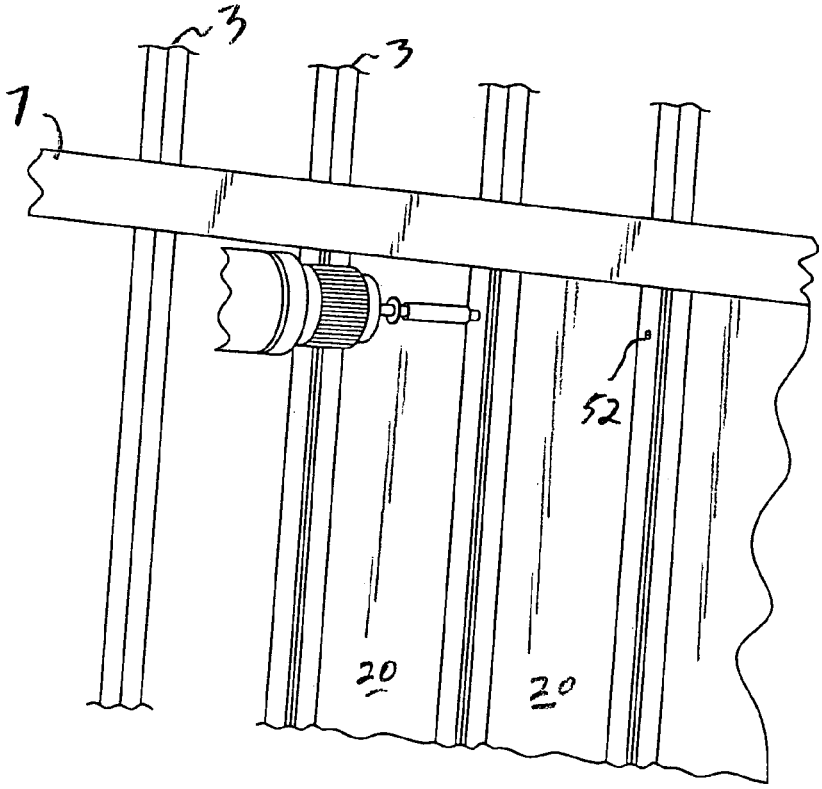
FIG. 2 is a partial cutaway view showing the drilling of holes through overlapping panels and a picket.
Figure 3:
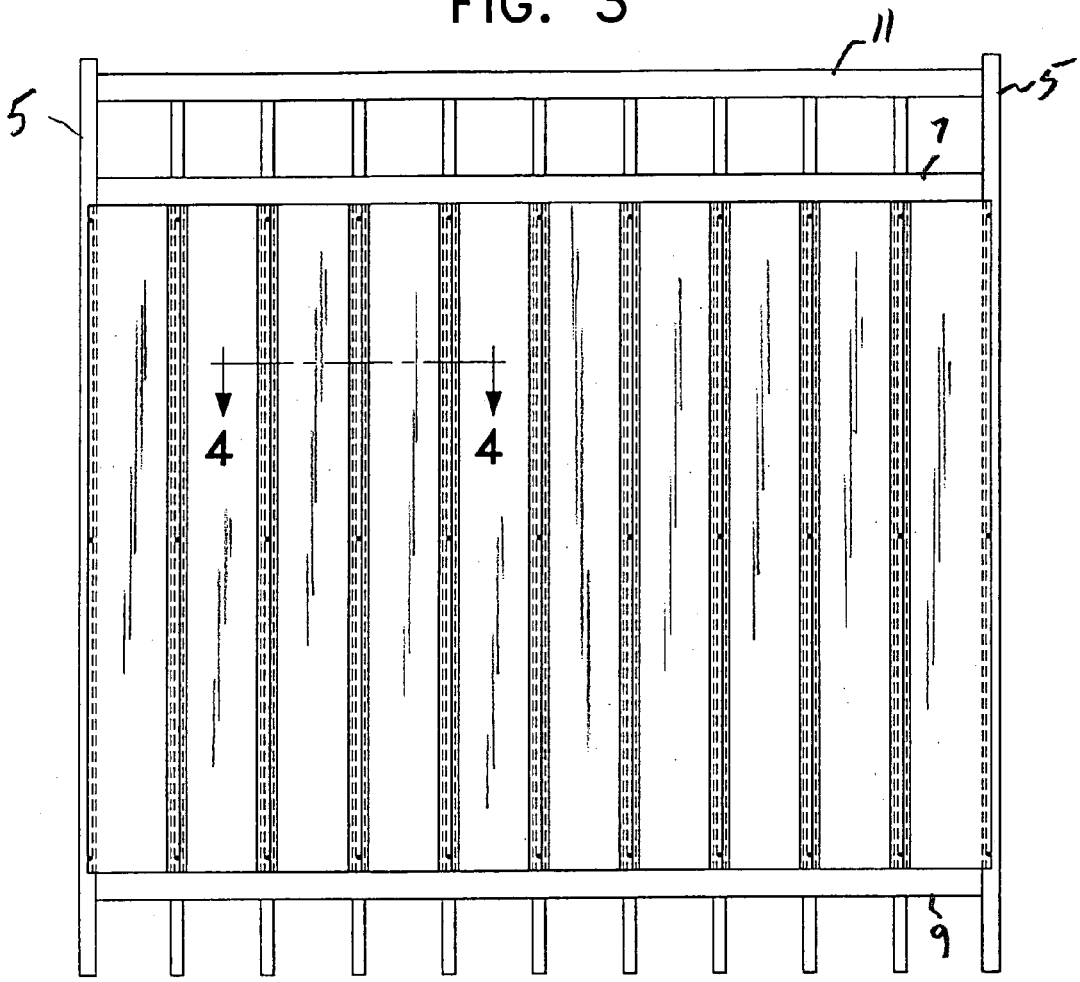
FIG. 3 is a front view of an ornamental fence section with privacy panels installed thereon.

As shown, for example, in FIG. 2, the panels 20 are inserted between adjacent pickets and at least two panels are placed in adjacent openings, where the attachment wings overlap and overlie the picket. Self-tapping stainless steel screws are then drilled into the overlapping panels and pickets 50 (although other screws or fasteners can be used) affixing the panels to the pickets. Alternatively, the attachment wings may have holes pre-drilled therethrough 52.

The panels 22 are extruded from durable outdoor grade plastic and include UV inhibitors. The material will be impervious to chemicals and environmental conditions and cleaning can be easily accomplished with high-pressure sprays, garden hoses or regular household detergents. The system can be supplied in packages or sets having a fixed number of panels and screws and customers can order the number of sets needed for the particular fence system for which privacy is sought.

When installing ornamental fences, the spacing between a post, such as an end post 50 and adjacent picket or post (generically 30 in FIG. 6) will often need to be adjusted and customized for the particular fence application. This spacing could thus be less than the standardized spacing. Accordingly, the privacy panels must be able to accommodate this altered distance between the post 50 and adjacent picket 30. As shown in FIG. 6, an end post trim piece 60 is provided. The end post trim piece forms a right angle bend with respect to a cut-off central section 70 of a privacy panel 200. This right angle bend trim piece 60 defines an attachment flange 62 which is drilled into the side 52 of the end post 50 that faces the adjacent picket 30, as is shown.

To install the privacy panel 200 adjacent the post 50, the installer will first measure the spacing between the picket and the adjacent end post and then cut a privacy panel along its vertical length at 80 to remove one of the attachment wings and transition sections to form a free edge 80 so as to accommodate the narrower spacing. Then, a trim piece 60 is attached onto the free edge 80 of the cut panel 200 and this end piece will subsequently be fastened to the sidewall 52 of the end post 50. Accordingly, the distance between the remaining transition section, after cutting, and the free edge 80 of the cut central section, i.e., between 82 and 80, must be such that the panel, after affixing of the trim piece 60, will fit within and enclose the opening.

The trim piece 60 includes a first edge 62 defining a slot 64 having a slot gap sized to tightly and rigidly secure the cut central panel section 70 therewithin. As shown by the double arrow 65 in FIG. 6, the cut central section 70 of the panel 200 is inserted into the slot 64 by lateral manual movement by the installer on site after cutting and before installation. The trim piece 60 is elongated with a length substantially equal to the length of the privacy panels. Integrally extending from the first edge 62 is a face 66 that also provides for privacy by closing the gap between the free edge.80 of the cut privacy panel and the end post face 52.

The foregoing descriptions and drawings should be considered as illustrative only of the principles of the invention. As noted, the invention may be configured in a variety of shapes and sizes and is not limited by the dimensions of the preferred embodiment. Other similar modifications to the disclosed embodiments can also be made within scope of the instant inventive concepts. Thus, the foregoing descriptions and drawings should be considered as illustrative only of the principles of the invention.

What is claimed is:

1. A privacy panel system for a preexisting ornamental fence, said privacy panel system comprising: a plurality of vertical fence pickets, each having parallel front and back faces, disposable between a pair of vertical posts of said fence;

a set of privacy panels, each panel having a width greater than the spacing between adjacent fence pickets and a length substantially greater than the width, each said panel being opaque and made of a plastics material, each said panel having a single planar central section and a pair of attachment wings, each of which are integral with said central section through a transition section, said attachment wings parallel to said planar central section and offset therefrom a distance less than the distance between the front and back faces of the pickets so that the planar central section is recessed from the front faces of the pickets, said planar central section width not greater than the spacing between adjacent pickets so as to fit therewithin and wherein the attachment wings of adjacent panels may overlap each other and are affixable to the pickets;

an elongated trim piece having a length substantially equal to the length of said privacy panels, said trim piece being opaque and made of a plastics material, said trim-piece having a first edge defining a slot having a slot gap substantially equal to the thickness of said privacy panel to enable a free edge of a central section of said privacy panel to be tightly retained within said slot, said trim piece further comprising an integral trim piece attachment flange.

2. The privacy panel system of claim 1 wherein said plastics material is a durable outdoor grade plastic.

3. The privacy panel system of claim 1 further comprising attachment elements for affixing said attachment wings to the vertical fence pickets and for affixing said trim piece attachment flange to a vertical post.

4. The privacy panel system of claim 1 wherein said trim piece further comprises a privacy face integral with and extending from said first edge and parallel with said slot.

5. The privacy panel system of claim 1 wherein at least one privacy panel is cuttable along the vertical length of said central section to remove one of said attachment wings and form a free edge of said central section.

6. The privacy panel system of claim 1 wherein the width of said single planar central section is substantially equal to, but just less than, the spacing between adjacent pickets.

7. The privacy panel system of claim 6 wherein the distance between adjacent pickets is approximately 4".

8. An ornamental fence combined with privacy panels affixed thereto comprising:

an ornamental fence comprising a plurality of vertically disposed parallel elongated pickets, each picket of rectangular cross-section having a front face, a back face, and a pair of side faces, at least one vertical post adjacent at least one of said pickets, and at least one horizontally disposed rail intersecting the parallel pickets and post to define vertically elongated rectangular fence openings;

a plurality of privacy panels affixed to the ornamental fence between adjacent pickets and covering said rectangular fence openings, each privacy panel comprising an opaque plastic panel having a width greater than the spacing between adjacent pickets and a length sufficient to cover the rectangular fence opening, each said panel being of uniform thickness, each said panel having a single substantially planar central section and a pair of attachment wings, each integral with said central section through a transition section, said attachment wings parallel to said planar central section and offset therefrom with each transition section substantially perpendicular to the central section and attachment wings, the central section positionable within, and enclosing, said vertically elongated rectangular fence opening with each said transition section in facing relationship to a side face of adjacent pickets and wherein said attachment wings overlie one of said front and back faces of adjacent pickets for attachment thereto and wherein the attachment wings of adjacent privacy panels overlap each other and are affixed to a rectangular face of the pickets by screws.

9. The combination of claim 7 further comprising an end privacy panel between a picket and an adjacent post, which includes includes only a single attachment wing and includes a free edge, and further comprising an elongated trim piece having a length substantially equal to the length of the end privacy panel, said trim piece being opaque and made of a plastics material and having a first edge defining a slot having a slot gap substantially equal to the thickness of said end privacy panel, the free edge of the end privacy panel inserted within and tightly retained within said slot, said trim piece further comprising an integral trim piece attachment flange affixed to the post.

10. The combination of claim 9 wherein said trim piece includes a facing integral with and extending from the first edge and parallel with said slot.

11. The combination of claim 8 wherein the distance between adjacent pickets is approximately 4".

12. An ornamental fence combined with privacy panels affixed thereto comprising:

an ornamental fence comprising a plurality of vertically disposed parallel elongated pickets, each picket of rectangular cross-section having a front face, a back face, and a pair of side faces, at least one vertical post adjacent at least one of said pickets, and at least one horizontally disposed rail intersecting the parallel pickets and post to define vertically elongated rectangular fence openings;

a plurality of privacy panels affixed to the ornamental fence and covering said rectangular fence openings, each privacy panel between adjacent pickets comprising an opaque plastic panel having a width greater than the spacing between adjacent pickets and a length sufficient to cover the rectangular fence opening, each said panel being of uniform thickness, each said panel having a single substantially planar central section and a pair of attachment wings, each integral with said central section through a transition section, said attachment wings parallel to said planar central section and offset therefrom with each transition section substantially perpendicular to the central section and attachment wings, the central section positionable within, and enclosing, said vertically elongated rectangular fence opening with each said transition section in facing relationship to a side face of adjacent pickets and wherein said attachment wings overlie one of said front and back faces of adjacent pickets for attachment thereto and wherein the attachment wings are offset from the central section a distance less than the distance between said front and back faces of the picket so that the central section is recessed from the front of the ornamental fence pickets.

* * * * *